United States Patent [19]

Holmes et al.

[11] 4,267,415

[45] May 12, 1981

[54] CURRENT LIMITER VACUUM ENVELOPE

[75] Inventors: Francis A. Holmes, Monroeville; Clive W. Kimblin; Joachim V. R. Heberlei, both of Pittsburgh, all of Pa.

[73] Assignee: Electric Power Research Institute, Palo Alto, Calif.

[21] Appl. No.: 839,813

[22] Filed: Oct. 6, 1977

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 1,819,154 | 8/1931 | Eschholz | 200/144 B |
| 2,976,382 | 3/1961 | Lee | 200/144 B |
| 3,178,541 | 4/1965 | Jennings | 200/144 B |
| 4,021,628 | 5/1977 | Kimblin | 200/144 B |

FOREIGN PATENT DOCUMENTS

| | | | |
|---|---|---|---|
| 563140 | 11/1932 | Fed. Rep. of Germany | 200/144 B |
| 569123 | 1/1933 | Fed. Rep. of Germany | 200/144 B |
| 1391515 | 1/1965 | France | 200/144 B |
| 1511782 | 12/1967 | France | 200/144 B |
| 571959 | 1/1958 | Italy | 200/144 B |

*Primary Examiner*—Robert S. Macon

*Attorney, Agent, or Firm*—Flehr, Hohbach, Test, Albritton & Herbert

[57] ABSTRACT

An improved envelope for a vacuum-type current interrupter of the type having a pair of relatively movable electrodes. The envelope includes end portions which support the electrodes and an intermediate insulating portion which surrounds and is spaced from the electrodes. Baffles are provided along the interior surface of the insulating portion to break up continuous metallic vapor deposits on the interior of the envelope.

2 Claims, 4 Drawing Figures

CURRENT LIMITER VACUUM ENVELOPE

BACKGROUND OF THE INVENTION

The invention relates to current interrupters of the vacuum-type for use in controlling fault currents associated with transmission lines in power distribution systems.

Increased electric power demand has led utility systems to use higher voltages in the transmission of power. Fault currents, due to ground shorts for example, can rapidly increase on high voltage lines. Therefore, as transmission voltages rise there is a continuous need in the electric power industry for improved current limiting devices capable of rapidly controlling high fault currents.

One type of current limiting circuit employs a vacuum-type current interrupter in parallel with a current-suppressive load. Such an interrupter employs a pair of relatively movable electrodes within an evacuated envelope. The movable electrodes can be placed in electrical contact to provide a free path for current flow. When excessive current is detected the electrodes are rapidly separated. Arcing then occurs across the interelectrode gap. The arcing causes a cloud of metallic vapor to arise within the evacuated envelope, the vapor eventually being deposited on the interior walls of the envelope.

In a standard current interrupter the evacuated envelope is cylindrical in shape with the electrodes being supported from the ends. The cylindrical portion is formed of an insulating material such as ceramic or glass. The end caps which support the electodes are metal. In order to successfully interrupt the flow of current, no conductive path can exist between the end caps along the insulated cylindrical portion. However, each time an interrupter is used, metallic arcing vapor deposits accumulate on the interior surface of the insulating wall. This metallic buildup can eventually cause current paths between the end caps which either short out the interrupter or severely limit the transient voltages it can withstand.

One means of preventing metallic vapor deposits on the interior walls of the insulation portion is to suspend a metal arcing shield within the envelope. The shield surrounds the electrodes so that the arcing vapors are deposited on the shield, rather than on the insulating walls. The metal shield prolongs the life of the interrupter but presents problems when used in interrupters employing magnetic arc suppression.

It has been found that the presence of a metal arc shield around the electrodes within the vacuum envelope tends to degrade the performance of a magnetic arc suppression interrupter. It is known, for example, that in interrupters without such a shield the maximum interruptable current is a function of the interelectrode magnetic flux density. Increasing the strength of the transverse magnetic field leads to improved performance. With a metal shield suspended in the envelope, however, it has been found that performance increases with the strength of the magnetic field only to a point, after which further increases in magnetic field strength actually tends to decrease performance. This is thought to be due to the presence of eddy currents generated within the metal arc shield. Another problem associated with the metal arc shield is that it provides additional current paths transverse to the lines of magnetic force. It is only when arcing proceeds transverse to the lines of magnetic force that magnetic arc suppression is effective. If arcing instead occurs along the lines of magnetic force, from the electrode to the shield and back to the other electrode, the magnetic field is ineffective to extinguish the arc. It is therefore most desirable when using magnetic arc suppression to dispense with the metal shield.

OBJECTS AND SUMMARY OF THE INVENTION

It is an object of the invention to provide a vacuum current interrupter having improved performance and longer life.

Another object of the invention is to provide such an interrupter in which metallic arcing vapors deposited on the insulating wall portions of the vacuum envelope do not form continuous current paths between the conductive end portions of the envelope.

Accordingly, a current interrupter is provided for rapidly interrupting currents associated with power line faults having an evacuated envelope with a pair of relatively movable electrodes disposed therein. The evacuated envelope has spaced end portions and an intermediate insulating portion sealed to the end portions. The insulating portion forms a surrounding wall around and spaced from the electrodes. Each of the electrodes are supported by one of the end portions of the envelope. The electrodes are relatively movable within the envelope into contact to complete an electrical path and are also separable to induce current interruption thereby causing arcing between the electrodes. At least a portion of the interior surface of the surrounding insulating portion of the envelope includes baffles which prevent metallic arcing vapors deposited on the baffles and the interior surface of the insulating portion from forming continuous current paths along the insulating portion between the end portions of the envelope.

DESCRIPTION OF THE PREFERRED EMBODIMENT

Figure 1:
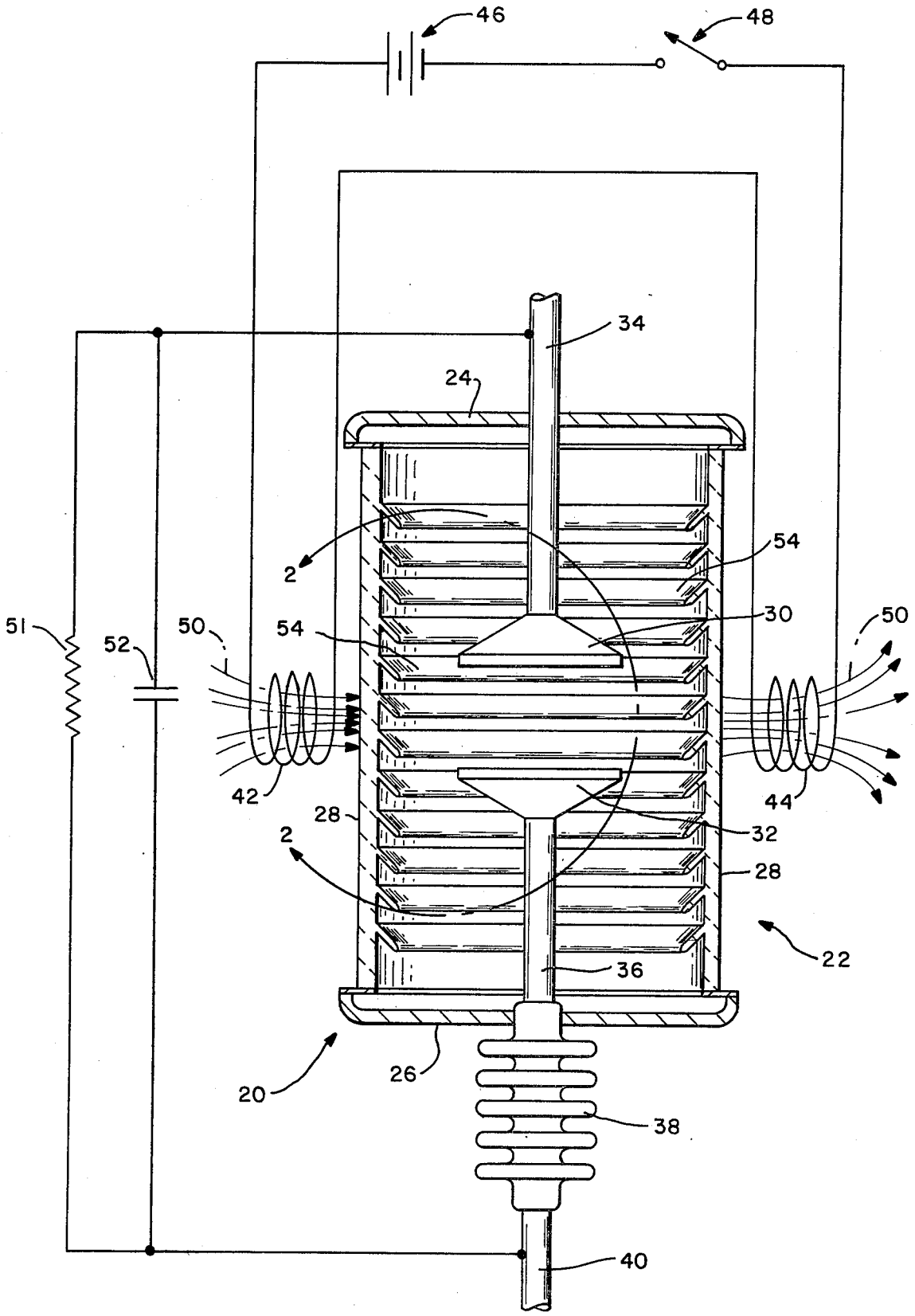
FIG. 1 is a cross sectional view through a vacuum-type current interrupter connected in a current-limiting circuit and having an envelope according to the invention.

Referring to FIG. 1, current interrupter 20 is connected as one parallel branch of a current limiting circuit. Interrupter 20 includes evacuated envelope 22 having spaced end portions 24, 26 and an intermediate insulating portion 28 formed of insulating material such as glass or ceramic. Insulating portion 28 is substantially cylindrical in shape with the ends being closed by end caps 24 and 26, preferably formed of metal. Suitable seals are provided between the end caps and the intermediate insulating portion so that the envelope may be evacuated to an extent sufficient to insure a mean free electron path between the electrodes which prevents gaseous breakdown. For this purpose the pressure should be lower than approximately $10^{-4}$ torr.

A pair of electrode members 30 and 32 are supported within envelope 22. Each electrode is supported by one of the end caps 24 and 26. The electrode members are relatively movable within the envelope into and out of mutual contact. They are relatively movable along a common axis which is the axis of the cylindrical insulating portion 28. In the preferred embodiment, electrode 30 is suitably supported by portion 34 which extends through and is sealed to end cap 24. Electrode 32 is movable and includes supporting portion 36 attached to the lower end of exterior bellows 38, as shown in FIG. 1. Bellows 38 is in turn suitably sealed to end cap 26 so as to permit movement of electrode 32 while maintaining a vacuum within the envelope. Suitable actuating means (not shown) are coupled to the lower end 40 of electrode 32 for moving the electrode between its open position, as shown in FIG. 1, and its closed position with the electrodes in contact.

Current interrupter 20 also includes means for producing a magnetic field between electrodes 30 and 32 to rapidly extinguish the arc which arises between them after separation. Such means includes coils 42, 44 disposed outside envelope 22. The coils preferably have an independent power supply 46 and are energized by switch 48. The coils produce a magnetic field having lines of magnetic force 50 which extend between the electrodes transverse to their axis of relative movement.

In the preferred embodiment the current interrupter is placed on a power distribution line in parallel with a current limiting circuit adapted to rapidly reduce excessive current flow. Such current limiting circuit includes resistor 51 in parallel with capacitor 52. This circuit serves to maintain the current flowing therethrough within safe limits after the current path through interrupter is interrupted.

Figure 2:
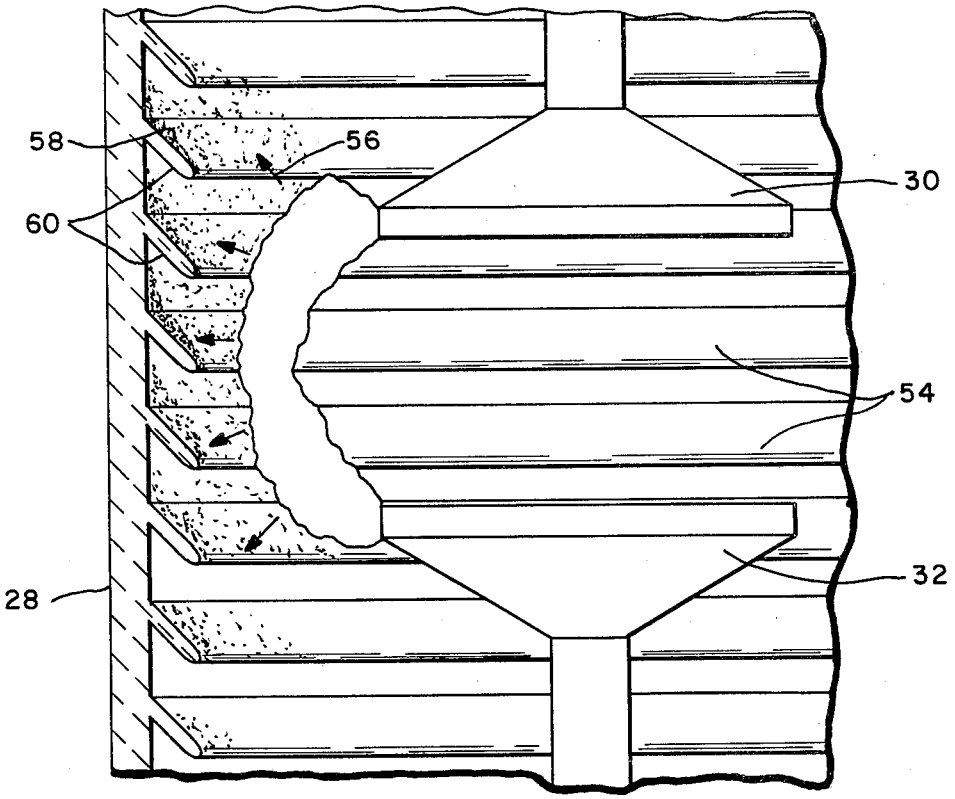
FIG. 2 is an enlarged partial view of the interrupter of FIG. 1 within the area of line 2—2.

The interior surface of intermediate insulating portion 28 includes baffles 54. These baffles comprise a plurality of spaced annular fins each of which extends around the interior surface of portion 28 forming an inwardly extending annular projection from the cylindrical wall. Referring to FIGS. 1 and 2, fins 54 are shown to project angularly inwardly from the interior surface of insulating portion 28. In the preferred embodiment the interior surface of insulating portion 28 is convoluted into fins 54 to form the baffles. Thus, the fins and the insulating portion comprise a unitary piece of insulating material.

In operation, the circuit shown in FIG. 1 is installed on line in a power distribution system with electrodes 30 and 32 in a closed position. Line current flows directly through interrupter 20. Apparatus (not shown) continuously monitors line current to detect a rapid current rise which indicates a line fault, such as a substantial path to ground for example. When a fault is detected the monitoring apparatus causes the previously mentioned actuator to separate the electrodes and induce current interruption. Immediately following separation an arc arises between the electrodes. Since the arc permits substantial current flow to continue between the electrodes, actual interruption does not occur until the arc is extinguished. To rapidly extinguish the arc after electrode separation the magnetic field is applied between the electrodes by closing switch 48.

The arcing which occurs between electrodes 30 and 32 causes release of ions of electrode material and other metallic arcing vapors from the surface of at least one of the electrodes. These arcing vapors spread out in the vacuum of the envelope and are deposited on the interior wall thereof. Most of the metallic arcing vapors are deposited on the surrounding insulating wall 28. Under the influence of the transverse magnetic field the arc and the vapors tend to be driven from between the separated electrodes into one of two directions, depending on the polarity of the electrodes at the moment of separation.

Referring to FIG. 2, an arc is shown just prior to being extinguished. FIG. 2 shows this interrupter rotated 90° from the view in FIG. 1, with the lines of magnetic force 50 running directly into the figure. If the current is from the lower electrode 32 to the upper electrode 30 the arc is driven in the $\overline{J} \times \overline{B}$ direction, which is to the left in FIG. 2. A substantial portion of the metallic arcing vapors are also driven to the left. Arrows 56 represent the direction of outward flow of the metallic arcing vapors which are eventually deposited on baffles 54 and the interior surface of insulating portion 28.

Because the interior of insulating portion 28 is convoluted and the metallic vapor particles travel in a substantially straight line, the metallic vapor deposits are prevented from forming a continuous current path along the insulating portion between the end caps of the envelope. Instead, metal deposits 58 are broken up into a series of short annular segments. Portions of the interior surface 60 which are shielded from metallic deposits remain non-conductive. Since fins 54 extend around the interior of insulating portion 28, the shielded portions 60 form annular interior portions which are maintained free from metallic vapor deposits. These annular portions break up the metallic deposits into segments and assure a high withstand voltage for the interrupter even after repeated current interruptions.

Figure 3:
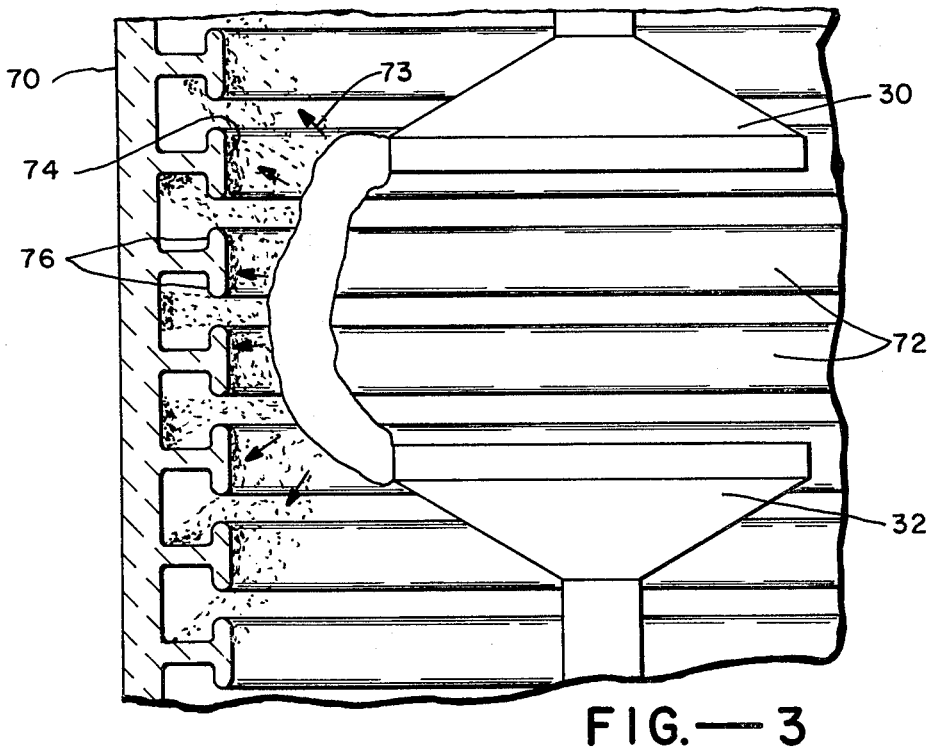
FIG. 3 is an enlarged view of another embodiment of the invention.

Referring to FIG. 3 an alternative embodiment of a vacuum-type circuit interrupter having an evacuated envelope according to the invention is shown. In this embodiment the electrodes and exterior circuitry are the same as in FIG. 1 with intermediate insulating portion 70 having baffles 72 on the interior surface thereof. Baffles 72 are again formed of a plurality of spaced annular fins, each having a T-shaped cross section. Fins 72 are spaced apart and each extend around the interior surface of insulating portion 70. Arcing vapors flow in the direction of arrows 73.

As in the previous embodiment, T-shaped fins 72 collect deposits of metallic arcing vapor 74 on the exposed portions thereof while shielding annular interior portions 76 of insulating portion 70 to maintain those portions free from such deposits. In that way the deposits are prevented from forming current paths along the interior walls of the envelope between the end portions.

Figure 4:
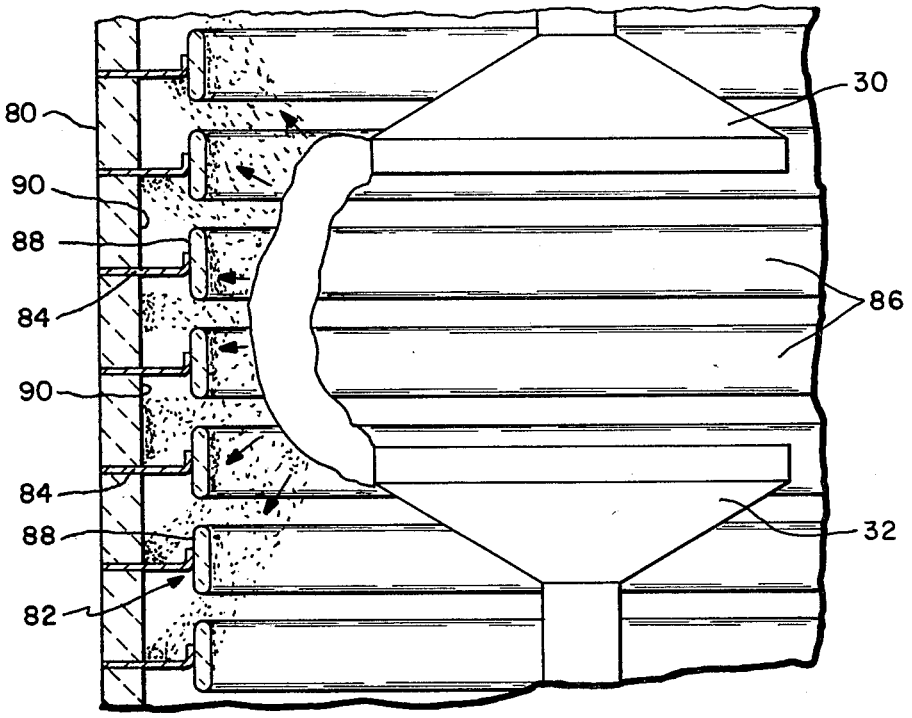
FIG. 4 is a view as in FIGS. 2 and 3 of another embodiment of the invention.

Another alternative embodiment of the invention is shown in FIG. 4. In this embodiment the electrodes and exterior circuitry are the same as in FIG. 1. The interrupter includes an intermediate insulating portion 80 between end caps 24 and 26. Baffles are again provided in the form of a plurality of spaced annular fins, each having a T-shaped cross section. The fins 82 each include a metal supporting portion 84 which is attached to insulating portion 80 and projects toward the interior of the envelope. Each fin also includes a shield portion 86 formed of insulating material suitably attached to the metal supporting portion. Shields 86 are generally in the form of wide rings which extend around the interior of the envelope. As before, the baffles protect underside portions 88 of shields 86, and also portions 90 of the insulating wall 80, thereby preventing metallic arcing vapor deposits from forming continuous current paths between the end portions of the envelope.

In the embodiment of FIG. 4 metal supporting portions 84 are shown to extend through the wall of insulating portion 80. This is more practical from an assembly standpoint than simply embedding the metal supporting portions into the interior surface of the insulating wall of the envelope, although such an approach would also work. In the embodiment shown, the insulating wall portion 80 comprises a stack of separate ring-shaped members alternated with and suitably sealed to metal supporting members 84, which are also ring-shaped.

The invention therefore provides for increased interrupter life by preventing continuous metal deposits along the interior wall of the envelope. This is done by interrupting the particles which tend to travel in a straight line. The need for internal metal vapor shields which degrade the performance of interrupters which employ magnetic arc extinction is eliminated.

Other embodiments of current interrupters having a vacuum envelope according to the invention are possible, including variations in the shape of the baffles employed. It is only necessary that the baffles provide some portion of the interior insulating wall that is shaded from vapor deposition so as to prevent continuous current paths. The baffles could be formed or attached to the insulating wall portion by means other than those shown. For example, the metal baffle supports of the embodiment shown in FIG. 4 could be attached to the envelope by depositing annular metalized rings onto the inner surface of the insulating wall and then bonding the metal supports to the metalized rings. Then the supports would not extend into the envelope walls. The baffles could also be formed of separate pieces of insulating material bonded to the interior of the insulating wall. It is unnecessary that the baffles extend completely around the interior wall of the insulating portion. If magnetic arc extinction is employed the vapors tend to be driven in a particular direction. Only those interior portions where heavy vapor deposition occurs need be equipped with baffles. It should therefore be understood that while particular embodiments of circuit interrupters have been shown, various modifications and changes may be made within the scope of the invention.

There has been provided a circuit interrupter with a vacuum envelope which prevents the formation of continuous current paths along the intermediate insulating portion thereof without the use of an interior arcing shield.

What is claimed is:

1. A current interrupter for rapidly interrupting currents associated with power lines comprising: an evacuated envelope having spaced end portions and an intermediate insulating portion sealed to said end portions, a pair of electrode members each supported within said envelope by one of said end portion of said envelope, said electrode members being relatively movable along an axis and within said envelope into mutual contact to complete an electrical path, said electrode members also being separable to induce current interruption thereby causing an arc to arise which carries arc current between said electrode members in a direction generally along said axis, means for producing a magnetic field between said electrode members to rapidly extinguish the arc, said magnetic field having lines of magnetic force transverse to said axis, said insulating portion of said envelope being spaced from and surrounding said electrode members and being substantially cylindrical in shape, wherein said lines of magnetic force act to drive the arc and metallic arcing vapors associated therewith from between the electrodes towards said insulating portion, the metallic arcing vapors being deposited on the surrounding insulating portion in heaviest concentrations on a localized area of an interior portion of said insulating portion where the vector cross product of the lines of magnetic force and said arc current intersects said insulating portion, and a plurality of spaced baffles formed on said insulating portion and juxtaposed to said arc which arises between said electrode members and at least covering said localized area of said interior portion where the metallic arcing vapors are deposited in the heaviest concentrations, said baffles being shaped and oriented to shield a plurality of continuous annular areas of said insulating portion from said metallic deposits in a direction perpendicular to said axis said insulating portion being substantially formed of electrically insulating material and said baffles forming a plurality of spaced annular fins having a T-shaped cross section and formed entirely of electrically insulating material.

2. A current interrupter for rapidly interrupting currents associated with power lines comprising: an evacuated envelope having spaced end portions and an intermediate insulating portion sealed to said end portions, a pair of electrode members each supported within said envelope by one of said end portion of said envelope, said electrode members being relatively movable along an axis and within said envelope into mutual contact to complete an electrical path, said electrode members also being separable to induce current interruption thereby causing an arc to arise which carries arc current between said electrode members in a direction generally along said axis, means for producing a magnetic field between said electrode members to rapidly extinguish the arc, said magnetic field having lines of magnetic force transverse to said axis, said insulating portion of said envelope being spaced from and surrounding said electrode members, wherein said lines of magnetic force act to drive the arc and metallic arcing vapors associated therewith from between the electrodes towards said insulating portion, the metallic arcing vapors being deposited on the surrounding insulating portion in heaviest concentrations on a localized area of an interior portion of said insulating portion where the vector cross product of the lines of magnetic force and said arc current intersects said insulating portion, and a plurality of spaced baffles formed on said insulating portion and juxtaposed to said arc which arises between said electrode members and at least covering said localized area of said interior portion where the metallic arcing vapors are deposited in the heaviest concentrations, said baffles being shaped and oriented to shield a plurality of continuous annular areas of said insulating portion from said metallic deposits in a direction perpendicular to said axis said insulating portion and baffles being subsantially formed of electrically insulating material said baffles comprising a plurality of fins each of which includes a metal supporting portion attached to said insulating portion and projecting toward the interior of said envelope, and a shield portion formed of electrically insulating material attached to said supporting portion whereby the plurality of shield portions prevent metallic arcing vapor deposits from forming continuous current paths between said end portions.

* * * * *